US008502741B2

(12) United States Patent
Lin et al.

(10) Patent No.: US 8,502,741 B2
(45) Date of Patent: Aug. 6, 2013

(54) STRUCTURE FOR ADJUSTING AN EM WAVE PENETRATION RESPONSE AND ANTENNA STRUCTURE FOR ADJUSTING AN EM WAVE RADIATION CHARACTERISTIC

(75) Inventors: Hung-Hsuan Lin, Taipei (TW); Chun-Yih Wu, Taichung (TW); Ken-Huang Lin, Kaohsiung (TW); Hsin-Lung Su, Kaohsiung (TW); Yi-Jen Wang, Tainan County (TW)

(73) Assignees: Industrial Technology Research Institute, Hsinchu (TW); National Sun Yat-sen University, Kaohsiung (TW)

( * ) Notice: Subject to any disclaimer, the term of this patent is extended or adjusted under 35 U.S.C. 154(b) by 401 days.

(21) Appl. No.: 13/012,805

(22) Filed: Jan. 25, 2011

(65) Prior Publication Data

US 2012/0105295 A1 May 3, 2012

(30) Foreign Application Priority Data

Nov. 2, 2010 (TW) ..... 99137645 A

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 841, 846
See application file for complete search history.

(56) References Cited

U.S. PATENT DOCUMENTS 6,559,803 B2 5/2003 Shinichi
6,657,595 B1 12/2003 Phillips et al.
6,798,168 B1 9/2004 Annamalai et al.
6,958,737 B2 10/2005 Lee et al.
7,382,319 B2 * 6/2008 Kawahata et al. ..... 343/700 MS
7,554,496 B2 6/2009 Qi et al.
7,672,698 B2 3/2010 Kang
2002/0196192 A1 * 12/2002 Nagumo et al. ..... 343/700 MS
2010/0113111 A1 5/2010 Wong et al.

OTHER PUBLICATIONS

Jianqing Wnag et al, "Effects of Ferrite Sheet Attachment to Portable Telephone in Reducing Electromagnetic Absorption in Human Head", issued on Aug. 2-6, 1999 in Seattle, WA, USA. p. 822-p. 825.
Sang Il Kwak et al, "SAR reduction on a mobile phone antenna using the EBG structures", Microwave Conference, 2008. EuMC 2008. 38th European, issued on Oct. 27-31, 2008 in Amsterdam, Netherlands. p. 1308-p. 1311.
Jiunn-Nan Hwang et al, "Reduction of the Peak SAR in the Human Head With Metamaterials", IEEE Transactions on Antennas and Propagation, vol. 54, No. 12, issued on Dec. 2006 in St. Petersburg, Russia. p. 3763-p. 3770.

* cited by examiner

*Primary Examiner* — Hoanganh Le
(74) *Attorney, Agent, or Firm* — Jianq Chyun IP Office

(57) ABSTRACT

A structure for adjusting electromagnetic wave (EM wave) penetration response includes a plurality of structure units and a dielectric substrate with an upper surface and a lower surface. The structure units are disposed on the upper surface and/or the lower surface. The structure unit consists of metal lines or complementary slits so as to enable an EM wave penetration response of the structure to include a pass band and a stop band. The frequency of the stop band is higher than that of the pass band. If a distance between the structure and an object with a high dielectric constant is longer than a predetermined distance, the pass band covers a radiation frequency of an antenna. If the distance between the structure and the object with the high dielectric constant is within the predetermined distance, the stop band covers the radiation frequency of the antenna.

16 Claims, 22 Drawing Sheets

STRUCTURE FOR ADJUSTING AN EM WAVE PENETRATION RESPONSE AND ANTENNA STRUCTURE FOR ADJUSTING AN EM WAVE RADIATION CHARACTERISTIC

CROSS-REFERENCE TO RELATED APPLICATION

This application claims the priority benefit of Taiwan application serial no. 99137645, filed on Nov. 2, 2010. The entirety of the above-mentioned patent application is hereby incorporated by reference herein and made a part of this specification.

TECHNICAL FIELD

The disclosure relates to a structure for adjusting an electromagnetic wave (EM wave) penetration response and an antenna structure for adjusting an EM wave radiation characteristic.

BACKGROUND

The specific absorption rate (SAR) is the most commonly used quantitative index for quantifying the influence on a human body of EM waves radiated by a mobile communication device presently, and is expressed by the following formula:

$$SAR = \frac{\sigma}{\rho}|E_i|^2$$

In above formula, σ represents a tissue conductivity (S/m), E represents an electric field strength root mean square value (V/m), and ρ represents a tissue density. It is evident from the formula that the SAR value is positively correlated to the incident electric field strength. When an antenna of the mobile communication device gets very close to the human body, the EM waves radiated by the antenna will make the SAR value get larger, and even exceed the regulation. Therefore, many research institutes adopt various methods to reduce the SAR value at present, so as to reduce the influence on the human body of the EM waves.

There are many methods for reducing the SAR value. Some method is to directly change the structure of the antenna to make the SAR value lower than the regulation. For example, in U.S. Pat. No. 6,958,737 B1, a loop antenna is used to reduce the SAR value, but it may need a large space for this kind of loop antenna.

Some methods are to add an additional element to reduce the SAR value. For example, in U.S. Pat. No. 6,798,168 B2, a copper strip is added to a mobile phone cell to reduce the SAR value; in U.S. Pat. No. 7,672,698 B2, an additional circuit (filter) is added to reduce the SAR value; in U.S. Pat. No. 6,559,803 B2, a dielectric sleeve is added to reduce the SAR value. However, due to the additional elements, although the effect of reducing the SAR value is achieved, the overall performance of the original antenna may usually deteriorate.

Moreover, some methods are to add a barrier between the human body and the antenna to reduce the SAR value. For example, a ferromagnetic material is used (e.g. J. Wang, O. Fujiwara and T. Takagi, "Effects of ferrite patch-shaped attachment to portable telephone in reducing electromagnetic absorption in human head", IEEE Int. Symp. on Electromagnetic Compatibility, vol. 2, pp. 822-825, 1999), or an electromagnetic band gap (EBG) structure is used (e.g. S. I. Kwak, D. U. Sim, J. H. Kwon and H. D. Choi, "SAR reduction on a mobile phone antenna using the EBG structures", 38th European Microw. Conf., pp. 1308-1311, October 2008), and a specific split-ring resonator (SRR) structure is used (e.g. J. N. Hwang, and F. C. Chen, "Reduction of peak SAR in the human head with metamaterial", IEEE Trans. Antennas Propag., vol. 54, no. 12, pp. 3763-3770, December 2006). Although the SAR value could be reduced by above three methods, the performance of the antenna is deteriorated oppositely.

Furthermore, in U.S. Pat. No. 6,421,016 B1, a method is presented for detecting whether a human body gets close in combination with a sensor and switching a current path with a switch to reduce the SAR value, but it is complicated and needs a large space.

In US Patent Publication No. US 2010/0113111 A1, the radiation energy is dispersed and gets away from the human head through guiding, but this technique does not give an overall design for the proximity effect when getting close to the human body, and thus the effect of reducing the SAR value cannot be obtained in the practical use close to the human body. In addition, after the device is installed, the radiation pattern of the antenna is influenced to have a strong directivity, which will impact the signal receiving effect of a handheld communication device.

SUMMARY

An exemplary embodiment of a structure for adjusting an EM wave penetration response is introduced herein. The structure includes a dielectric substrate and a plurality of structure units. The dielectric substrate is provided with an upper surface and a lower surface. The structure units are disposed on the upper surface, the lower surface, or the upper surface and the lower surface of the dielectric substrate. The structure units consist of a plurality of meandering metal lines, a plurality of metal patch-shaped structures, a plurality of complementary slits, or a combination thereof, to enable the EM wave penetration response of the structure for adjusting the EM wave penetration response to include a pass band and a stop band, in which the stop band is adjacent to the pass band, and a frequency of the stop band is higher than that of the pass band. Moreover, if a distance from the structure for adjusting the EM wave penetration response to an object with a high dielectric constant is higher than a predetermined distance, the pass band covers the radiation frequency of an antenna; if the distance from the structure for adjusting the EM wave penetration response to the object with the high dielectric constant is within the predetermined distance, the stop band covers the radiation frequency of the antenna.

An exemplary embodiment of an antenna structure for adjusting an EM wave radiation characteristic is further introduced herein. The antenna structure includes an antenna and the structure for adjusting the EM wave penetration response. The structure for adjusting the EM wave penetration response is disposed on a radiation path of the antenna, and is separated from the antenna by a pitch of lower than a ¼ wavelength (with respect to the wavelength of the radiation frequency of the antenna)

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION

Figure 1:
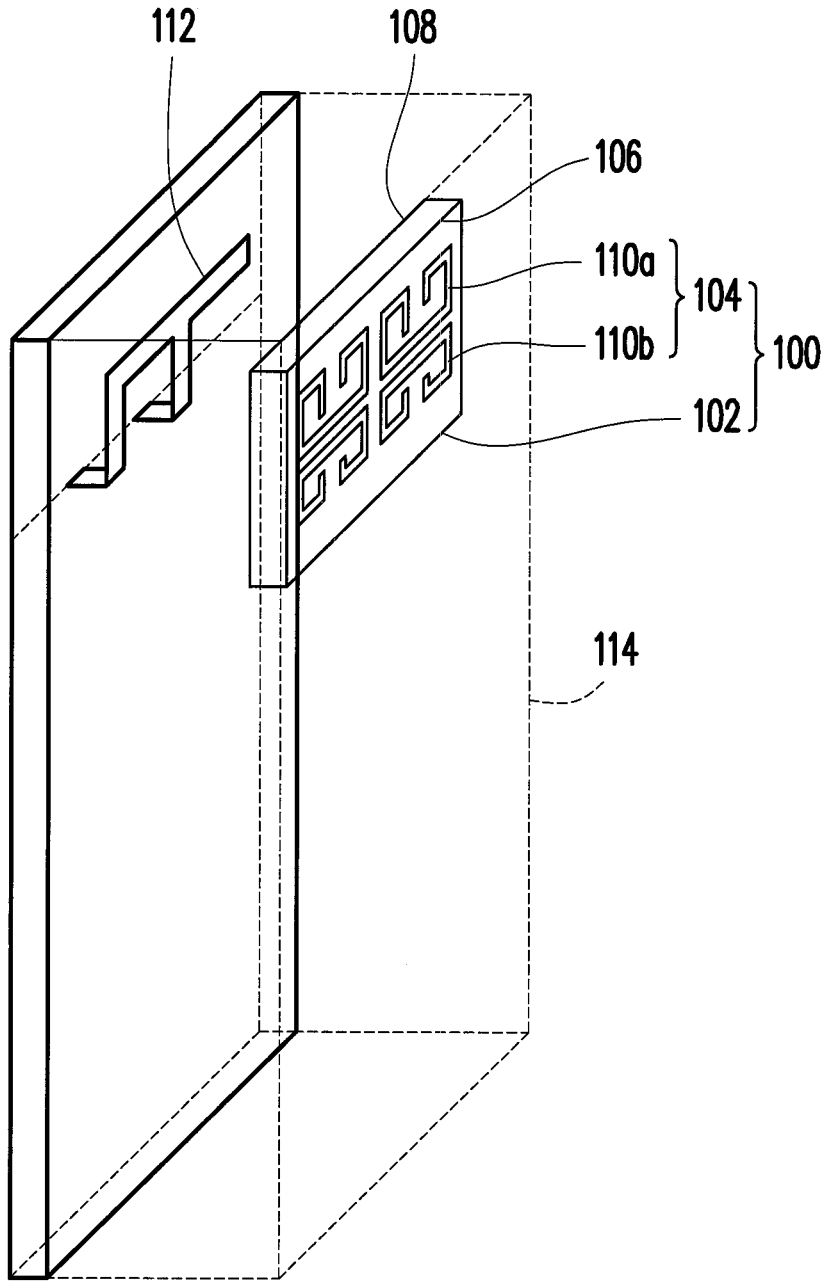
FIG. 1 is a schematic cross-sectional view of a structure for adjusting an EM wave penetration response according to an embodiment.

FIG. 1 is a schematic cross-sectional view of a structure for adjusting an EM wave penetration response according to an embodiment.

Referring to FIG. 1, a structure 100 for adjusting an EM wave penetration response includes a dielectric substrate 102 and a plurality of structure units 104. The dielectric substrate 102 is provided with an upper surface 106 and a lower surface 108. The structure units 104 are disposed on the upper surface 106 of the dielectric substrate 102, and definitely, the structure units 104 may also be selectively disposed on the lower surface 108 or the upper surface 106 and the lower surface 108 of the dielectric substrate 102, but the disclosure is not limited thereto. In this embodiment, a structure unit 104 consists of a plurality of metal lines (that is, a first unclosed loop 110*a* and a second unclosed loop 110*b* in a back-to-back manner), to enable an EM wave penetration response of the structure 100 for adjusting the EM wave penetration response to include at least one pass band and at least one stop band, and a frequency of the stop band is higher than that of the pass band. The EM wave penetration response of the structure 100 will be illustrated in detail with reference to simulation results hereinafter.

In FIG. 1, besides the structure 100 for adjusting the EM wave penetration response, a relative position of an antenna 112 is also shown. With the combination of the structure 100 for adjusting the EM wave penetration response and the antenna 112, an antenna structure capable of adjusting an EM wave radiation characteristic is obtained. Generally speaking, the structure 100 for adjusting the EM wave penetration response may be disposed inside a mobile communication device 114 or on a casing thereof, and should be located between an object with a high dielectric constant (for example, a human body) and the antenna 112 during use. In this embodiment, the antenna 112 is a planer inverted-F antenna (PIFA). In a similar size, a first order resonant frequency of an unclosed loop is generally lower than that of a closed loop. Therefore, the unclosed loop is usually adopted to reduce the size of a unit. However, according to a basic principle of frequency selective surface (FSS), a periodic metal structure of a single un-connected strip-shaped, patch-shaped, or meandering (in this embodiment) unclosed loop generates a frequency response of a band-stop filter, and provide a stop band in a frequency domain when being at the first order resonance. Under the parametric design of a limited dielectric substrate thickness, a metal line width, and a unit size, the frequency response of a single unclosed metal loop usually changes too slowly, and thus it is difficult to generate the high contrast between penetration losses when being away from and close to the object with the high dielectric constant. Therefore, in this embodiment, another unclosed metal loop with a similar size is added to the structure unit, to form another stop band in the frequency domain, and when the stop bands are adjacent to each other, a pass band with a steep slope is formed in the frequency range therebetween. According to this design concept, units of the structure 100 for adjusting the EM wave penetration response include a structure unit 104 containing a first unclosed loop 110*a* and a second unclosed loop 110*b*. The length ratio of the first unclosed loop 110*a* to the second unclosed loop 110*b* is between 1.02:1 and 1.41:1, with 1.14:1 being preferred, but the disclosure is not limited thereto.

Figure 2:
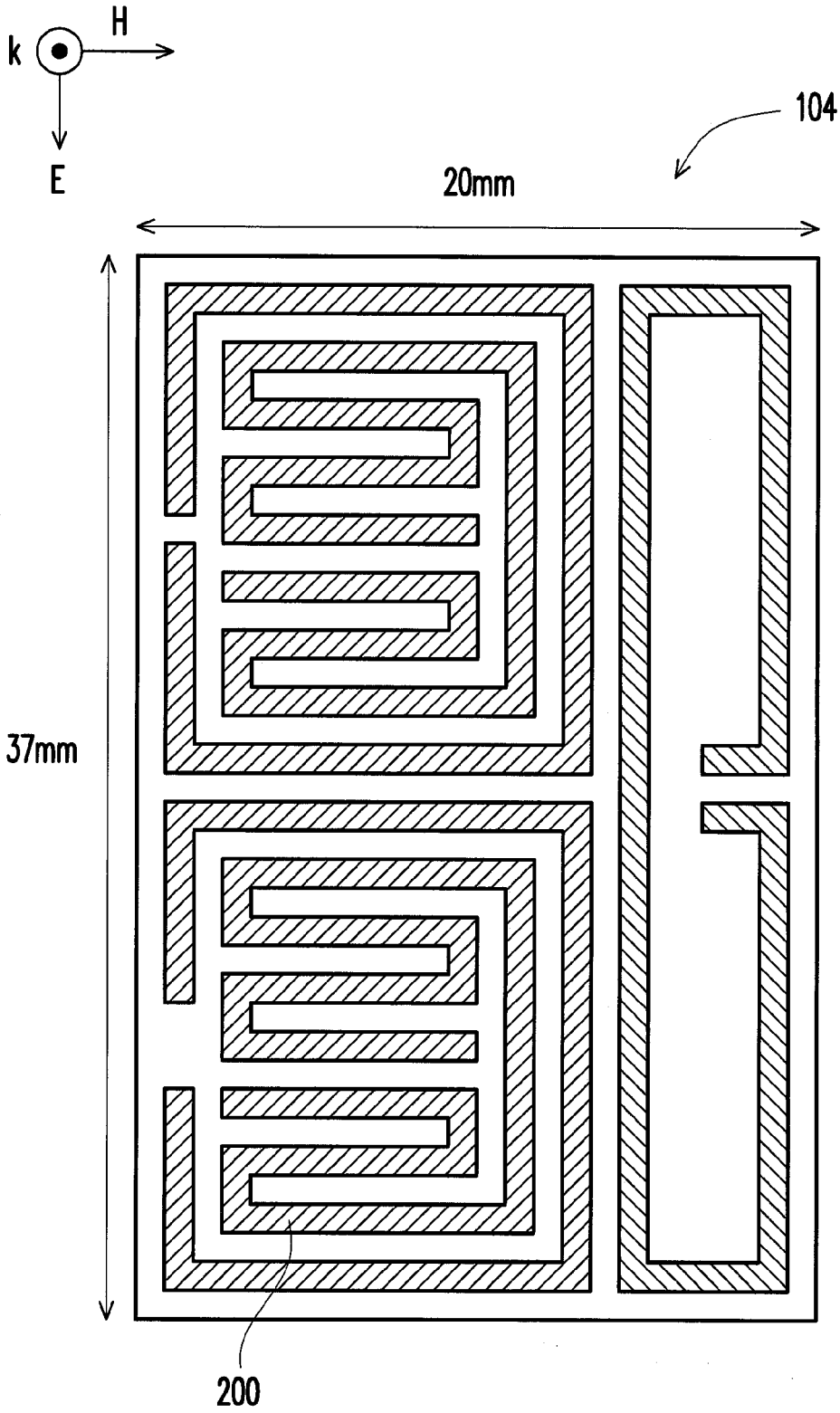
FIG. 2 is a schematic cross-sectional view of a structure for adjusting an EM wave penetration response according to another embodiment.

Following the same principle, a third unclosed loop 200 and a stop band may be further added, to enable the structure unit 104 to include two pass bands or thereby increasing the width of the stop band, as shown in FIG. 2.

Figure 3A:
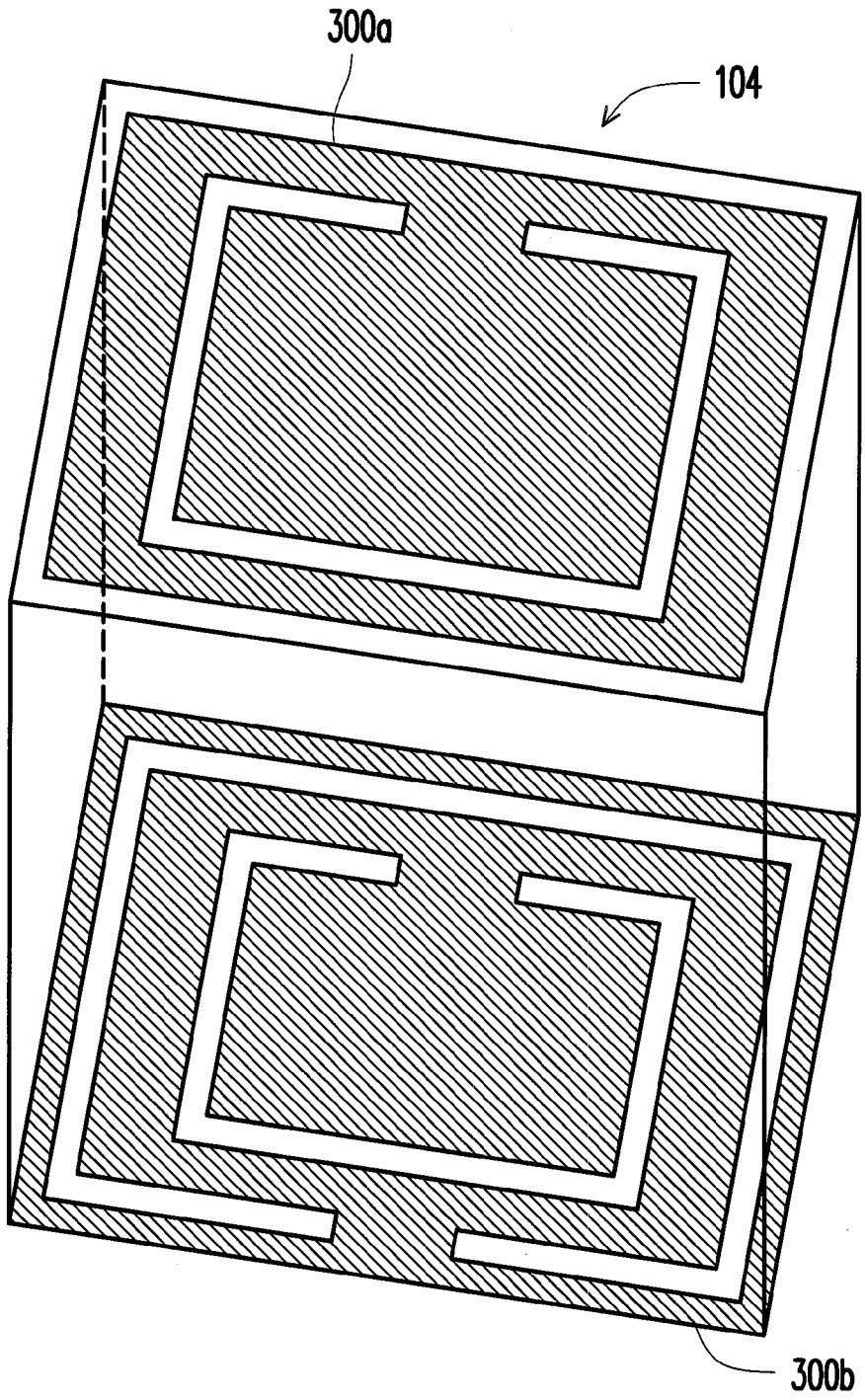
FIG. 3A is an exploded view of a structure unit in an embodiment.

Furthermore, according to the analysis of an equivalent circuit, when apertures, slots, and unclosed slits (that is, complementary structures of the unclosed loop) are opened on a continuous metal plane as FSS units, a frequency response of a band-pass filter is generated, and the first order resonance will provide a pass band. Therefore, the structure unit 104 may also consist of complementary unclosed slits or mixed slots and patch-shaped structures, to form a specific frequency response. Taking FIG. 3A (exploded view) and FIG. 3B (assembled view) as examples, the structure unit 104 consists of two layers of different metal slit structures 300*a* and 300*b*. An upper layer 300*a* includes a patch-shaped structure with an unclosed slit; a lower layer 300*b* includes two unclosed slits on a continuous metal plane. 300*a* and 300*b* are spaced and supported by the dielectric substrate 102. Furthermore, a metal post 302 supports 300*a* and 300*b* at the center of 300*a* and 300*b*, and thus the dielectric substrate 102 is not needed, such that the design is flexible, as shown in FIG. 3C.

Figure 4A:
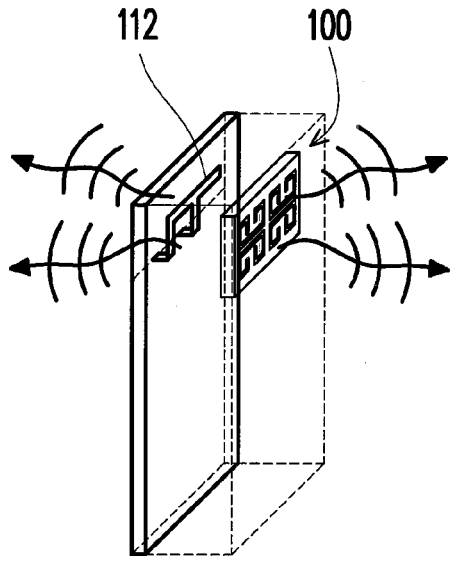
FIG. 4A is a schematic diagram of a mobile communication device in FIG. 1 emitting EM wave radiation when being far away from an object with a high dielectric constant.
Figure 4B:
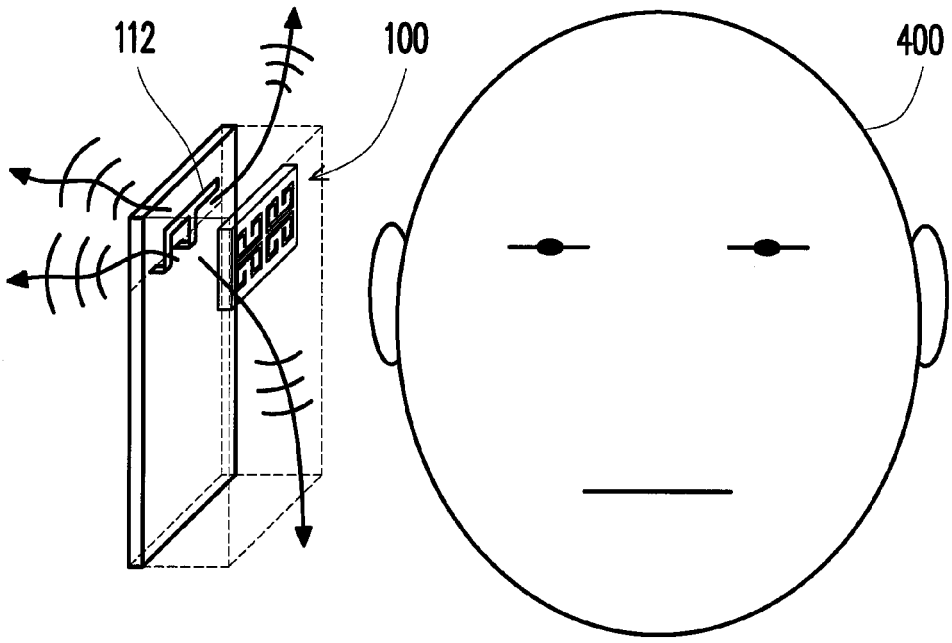
FIG. 4B is a schematic diagram of the mobile communication device in FIG. 1 emitting the EM wave radiation when being close to the object with the high dielectric constant.

When the distance from the structure 100 for adjusting the EM wave penetration response to the object with the high dielectric constant is higher than a predetermined distance, the pass band of the EM wave penetration response should cover the radiation frequency of the antenna 112, so as to maintain the total radiated power (TRP) of the antenna 112. As shown in FIG. 4A, the EM wave emitted from the antenna 112 is capable of penetrating and radiating freely. However, when the distance from the structure 100 for adjusting the EM wave penetration response to the object 400 with the high dielectric constant is close to the predetermined distance (such as, a reactive near-field region), the stop band of the EM wave penetration response of the structure 100 for adjusting the EM wave penetration response will gradually cover the radiation frequency of the antenna 112. The so-called "reactive near-field region" generally takes 0.159 times of a wavelength as a reference; for example, for an EM wave of 1.9 GHz, the predetermined distance is about 25.1 mm. Therefore, when the distance from the structure 100 for adjusting the EM wave penetration response to the object 400 with the high dielectric constant is within the predetermined distance, the stop band of the EM wave penetration response will cover the radiation frequency of the antenna 112, and as a result, the SAR of the object 400 with the high dielectric constant is reduced. As shown in FIG. 4B, the structure 100 for adjusting the EM wave penetration response between the object 400 with the high dielectric constant (for example, a human head) and the antenna 112 will reflect the EM wave, because the frequency response of the structure 100 for adjusting the EM wave penetration response (a resonance structure) will shift when being closing to the dielectric load with a high dielectric constant, that is to say, a penetration response curve of the structure 100 for adjusting the EM wave penetration response shifts towards a low frequency under a capacitance load, such that the structure 100 for adjusting the EM wave penetration response that is originally operated in a penetration band is changed to be operated in the stop band under a loading condition.

Hereinafter, several simulation tests are exemplified for proof.

First, material parameters are predetermined For reducing the SAR value so as to reduce the influence of an EM wave on a human body, the human body is adopted as a simulation target of the object with the high dielectric constant. In the following SAR value simulation tests, a human body model used has a frequency range of 1.8 GHz to 2.0 GHz, an equivalent dielectric constant $\epsilon_r$ of the human body is 53.3, and a tissue conductivity $\sigma$ is 1.52 S/m; an equivalent dielectric constant $\epsilon_r$ of the human head is 40.0, and a tissue conductivity $\sigma$ is 1.40 S/m.

Simulation 1

Figure 5A:
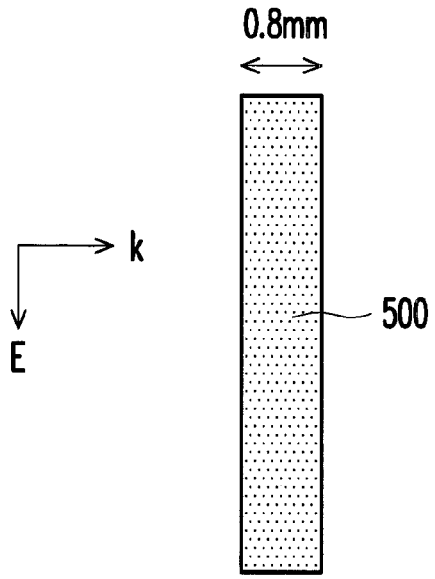
FIG. 5A is a side view of a structure unit used in Simulation 1.
Figure 5B:
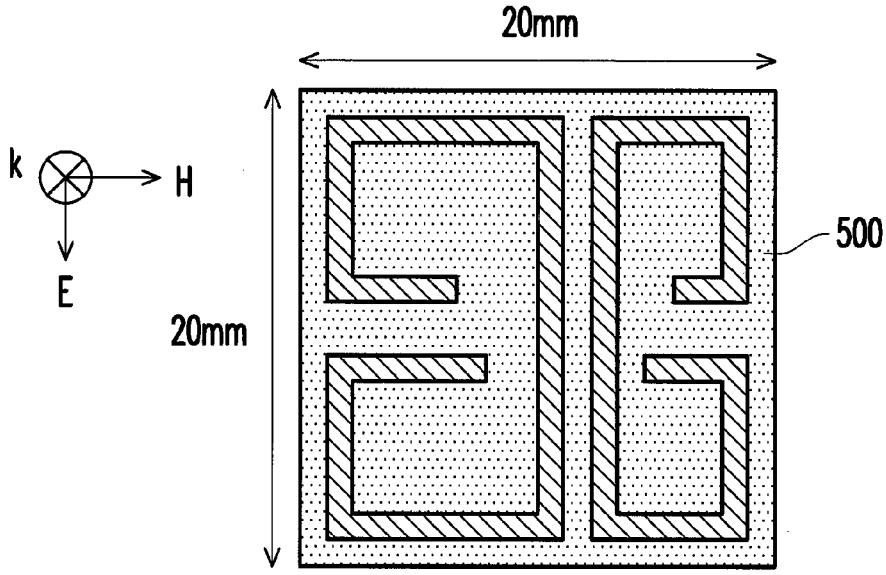
FIG. 5B is a front view of the structure unit used in Simulation 1.
Figure 6:
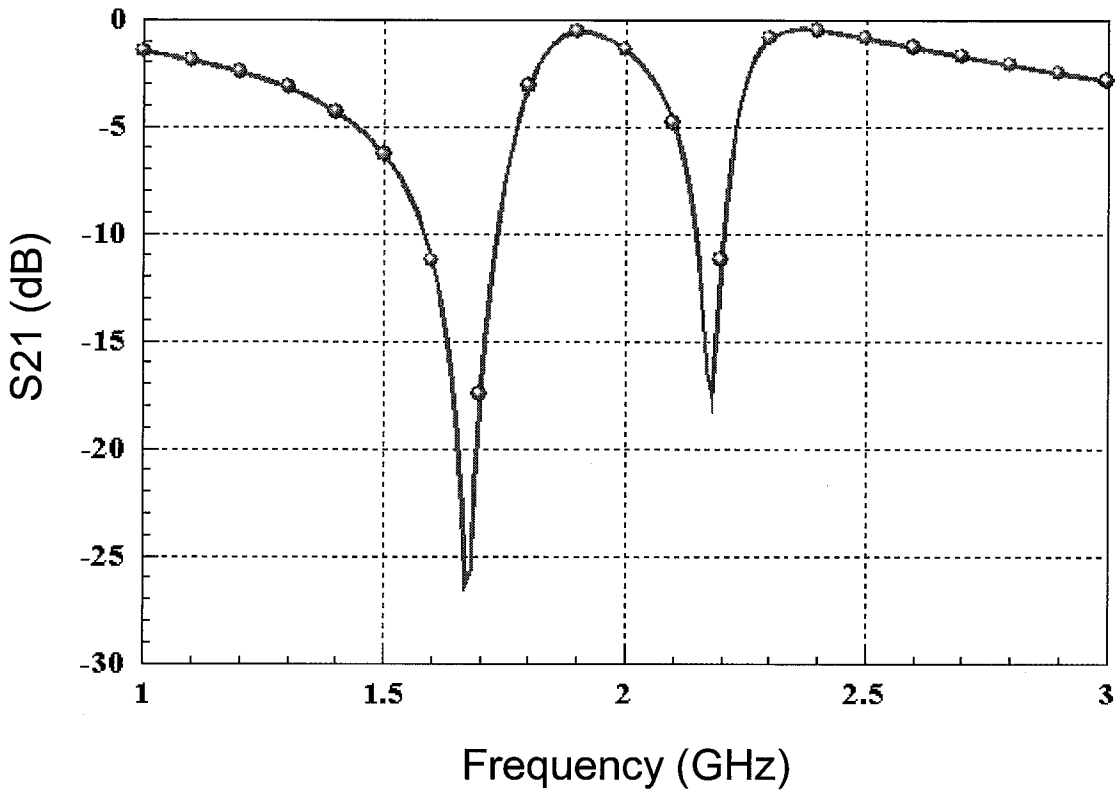
FIG. 6 is a simulation curve diagram of an EM wave penetration amount (S21) of the structure unit in FIG. 5B.

A device of FIGS. 5A and 5B is used to perform the simulation of plane wave normal incidence EM wave penetration, in which FIG. 5A represents a side face of a single structure unit 500, FIG. 5B represents a front face of the single structure unit 500. FIG. 6 shows the penetration amount (expressed as S21 of a scattering parameter (S-parameter)) of the simulation result. It can be known from FIG. 6 that, a pass band of an EM wave penetration response exists at a frequency of 1.8 GHz to 2.0 GHz, and a stop band exists at a higher frequency (about 2.2 GHz).

Figure 7:
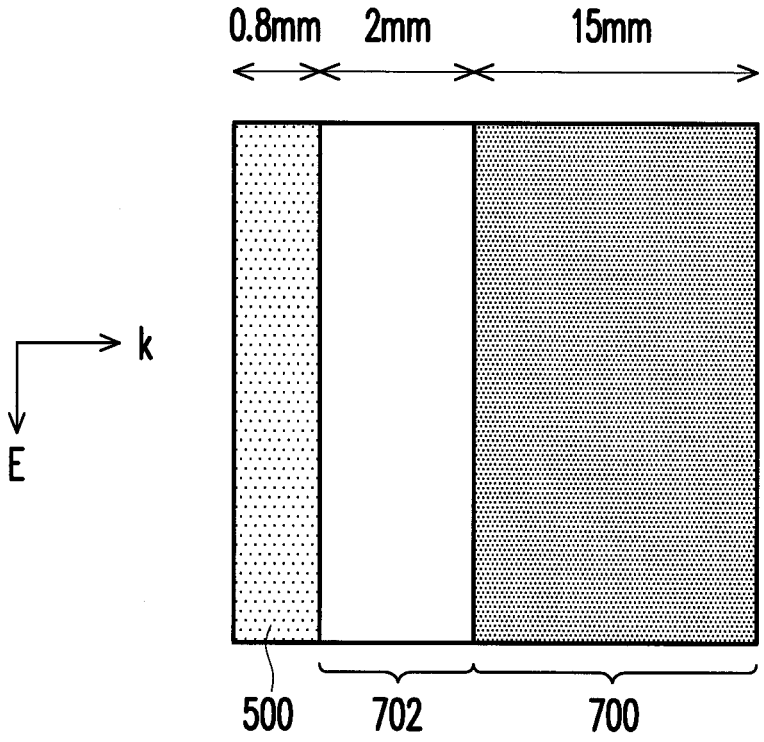
FIG. 7 is a side view of a phantom head and a phantom head capsule getting close to the structure unit in FIG. 5.
Figure 8:
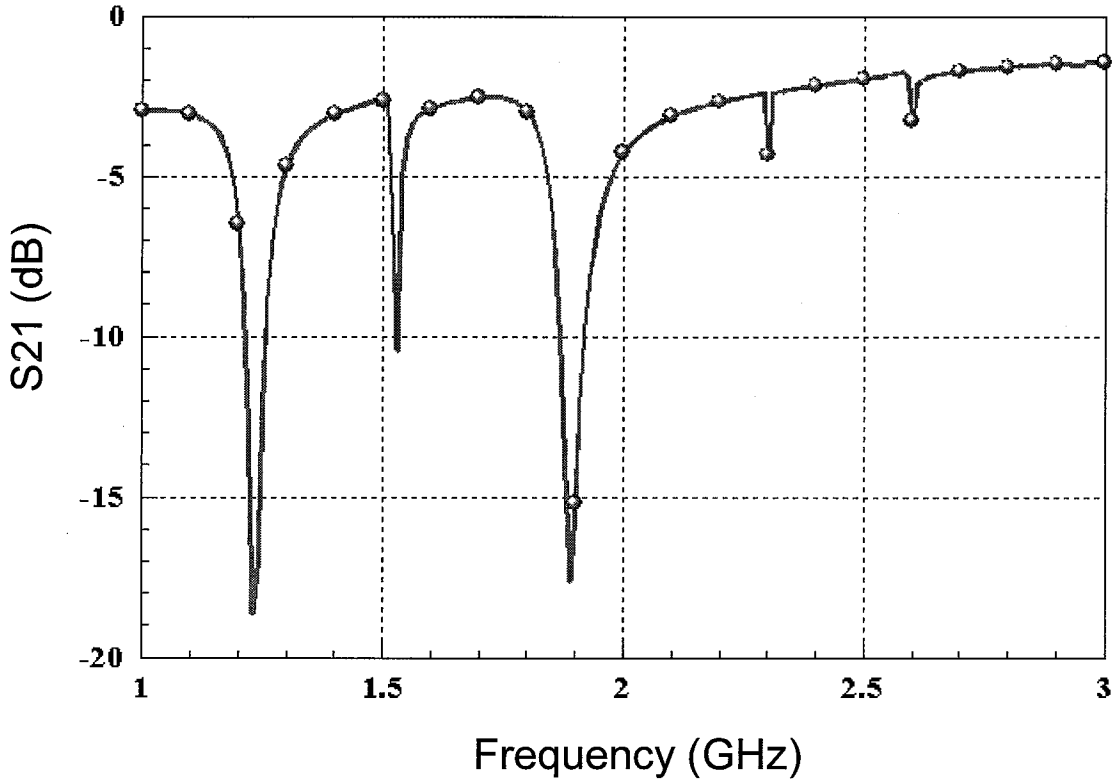
FIG. 8 is an S21 simulation curve diagram when the structure unit in FIG. 5 gets close to a phantom head.

When the device in FIG. 5A gets close to the human head, as shown in FIG. 7, and when a phantom 700 and a phantom shell 702 get close to the structure unit 500 in FIG. 5A, simulation results in FIG. 8 are obtained. In FIG. 7, the phantom 700 represents a human head tissue EM wave similar material and the phantom shell 702 represents a skin tissue EM wave similar material. It can be known from FIG. 8, the penetration response curve of the structure unit 500 shifts towards a low frequency, and thus the stop band that is initially at a higher frequency shifts towards the frequency of 1.8 GHz to 2.0 GHz, such that the penetration energy is reduced significantly, thereby the EM wave absorption of the human body is reduced.

Simulation 2

Figure 9:
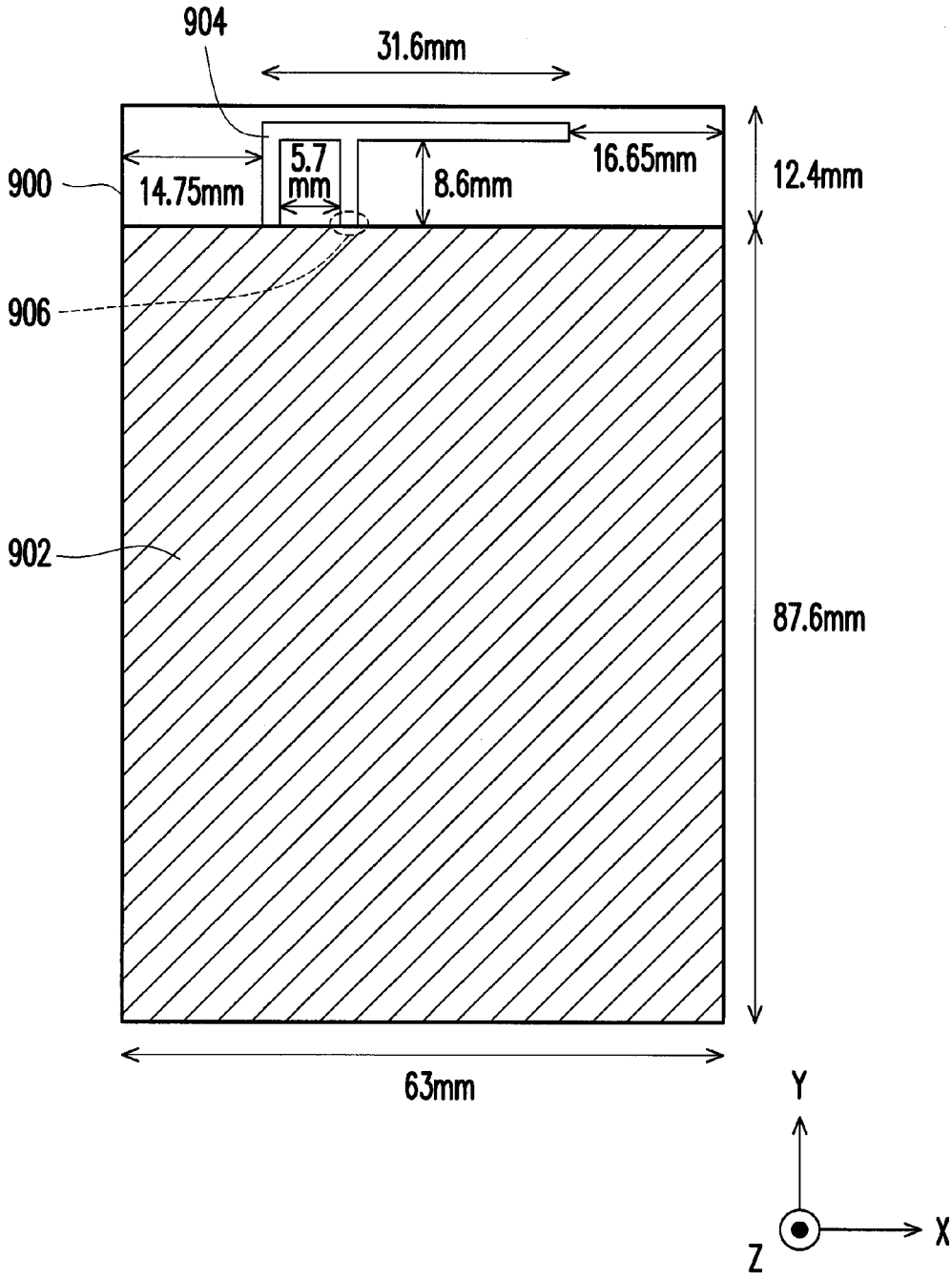
FIG. 9 is a front view of an antenna structure used in Simulation 2.

FIG. 9 is a front view of an antenna structure for simulation. The antenna structure includes a dielectric substrate 900, a metal ground plane 902, a microstrip antenna. 904, and a microstrip antenna feed source 906.

Figure 10:
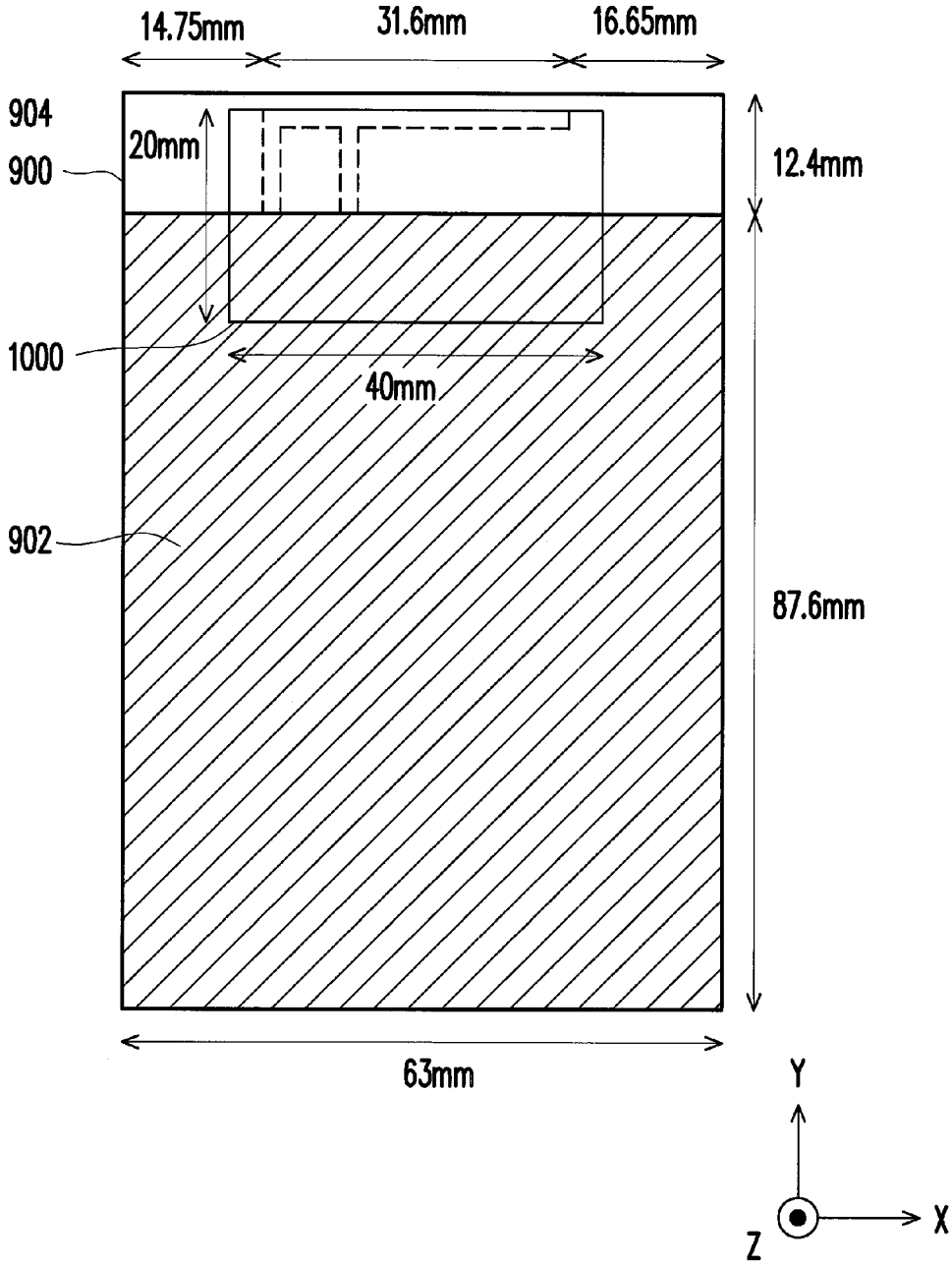
FIG. 10 is a front view of the antenna structure in FIG. 9 plus a structure consisting of two structure units in FIG. 5.
Figure 11:
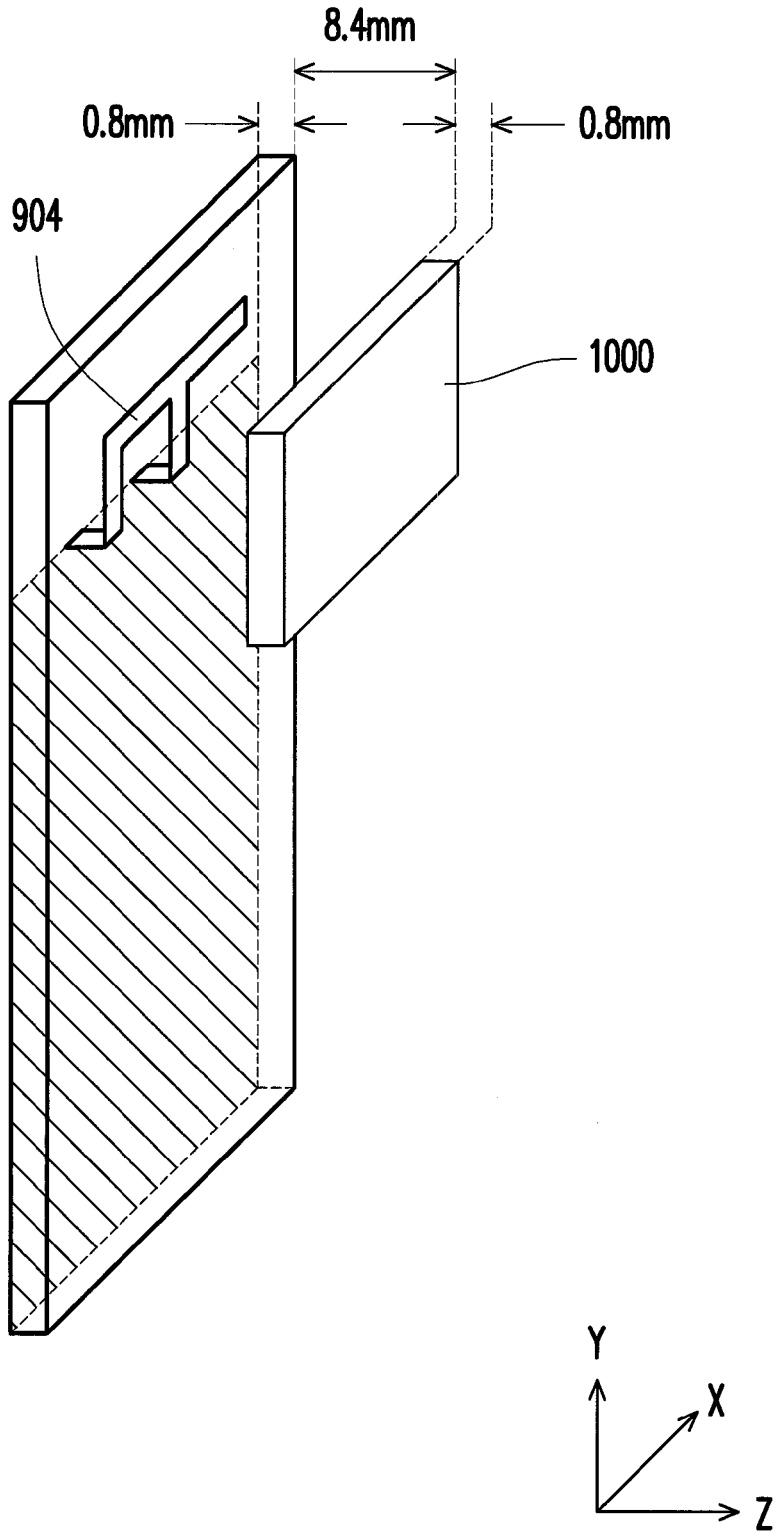
FIG. 11 is a three-dimensional view of FIG. 10.

FIG. 10 shows a structure 1000 for adjusting an EM wave penetration response consisting of the antenna structure in FIG. 9 plus two structure units (i.e., 500) in FIG. 5B. FIG. 11 is a three-dimensional view of FIG. 10, in which a distance from the structure 1000 for adjusting the EM wave penetration response to the antenna structure in FIG. 9 is about 8.4 mm.

Figure 12:
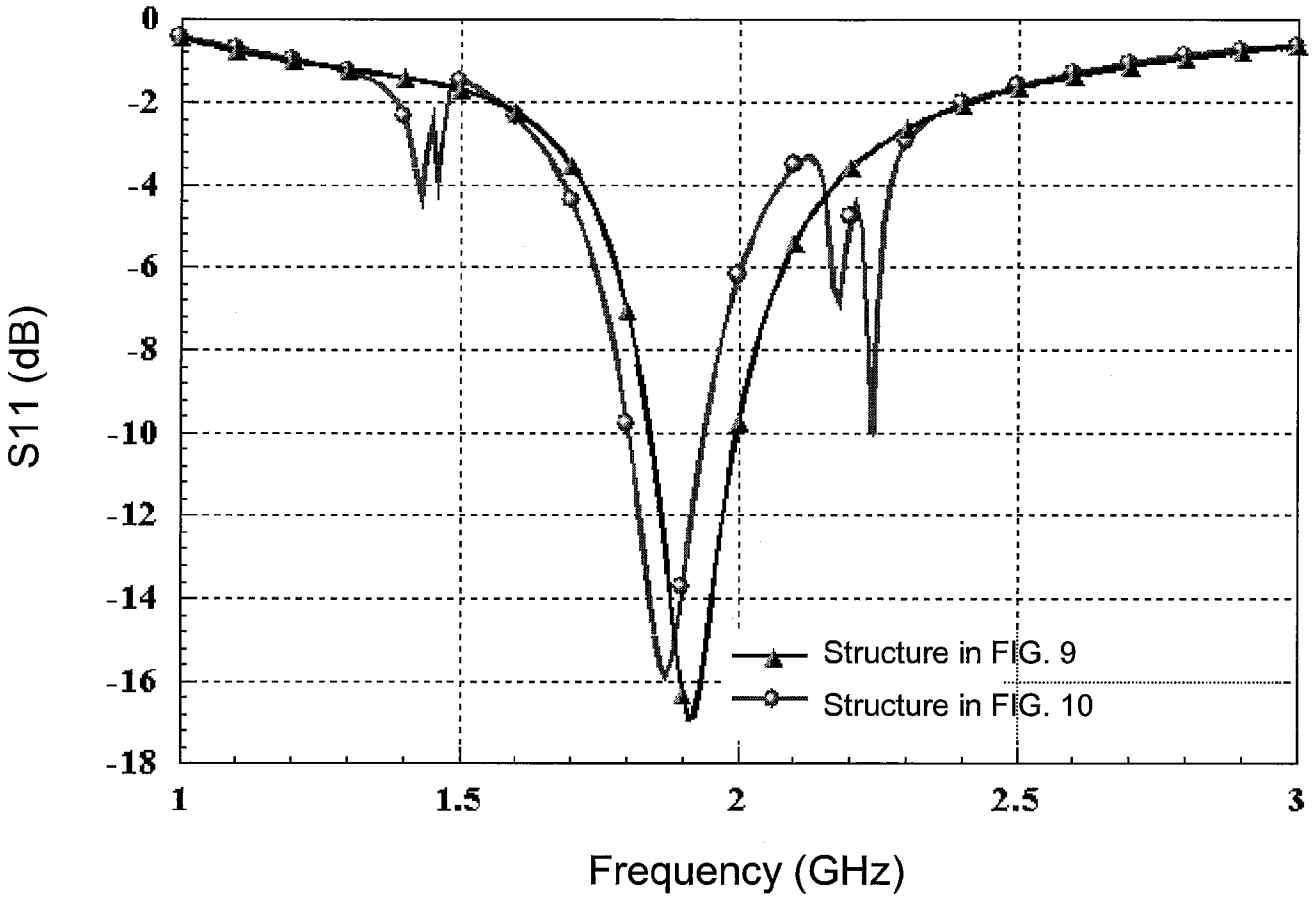
FIG. 12 is a simulation curve diagram simulating EM wave reflection amounts (S11) of the structures of FIGS. 9 and 10.
Figure 13A:
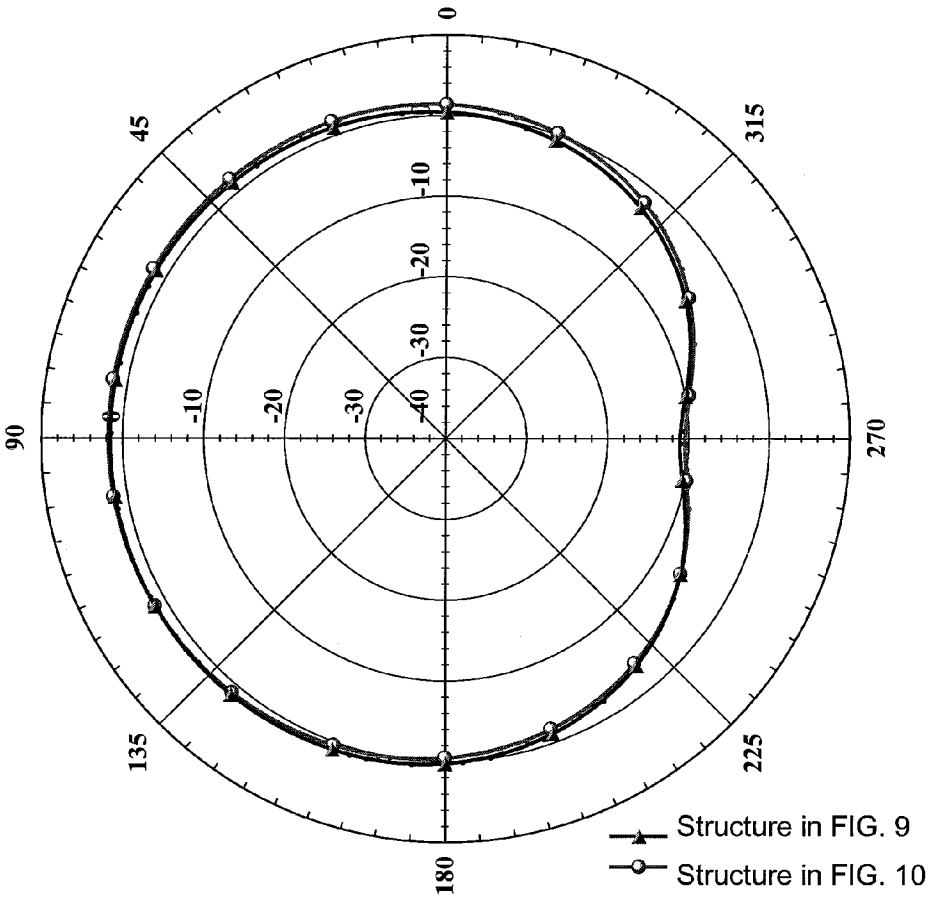
FIG. 13A is an x-z plane radiation pattern of the structures of FIGS. 9 and 10.
Figure 13B:
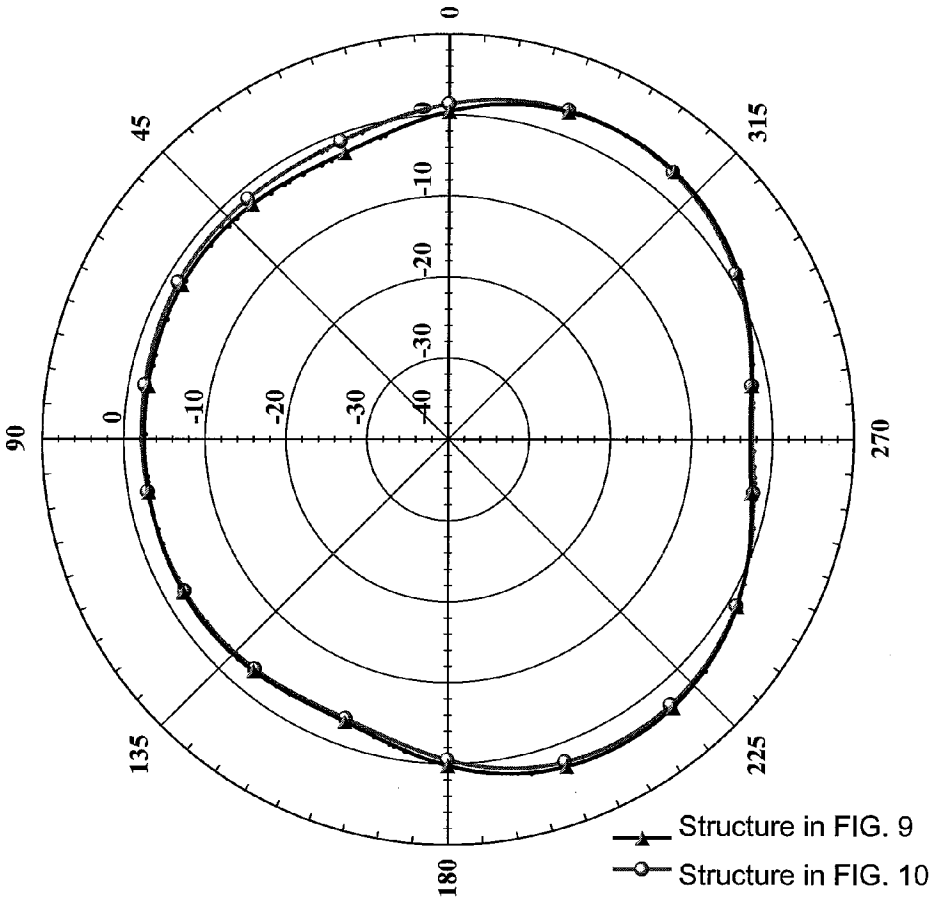
FIG. 13B is a y-z plane radiation pattern of the structures of FIGS. 9 and 10.

FIG. 12 shows that, by simulating the structures in FIGS. 9 and 10, a return loss of an EM wave reflection amount (expressed as S11 of the S-parameter) viewed from the antenna feed source 906 with or without the structure 1000 in a case of no load (being away from the object with the high dielectric constant) and obtained by simulation software is lower than −10 dB at an operation frequency point. FIGS. 13A and 13B are an x-z plane radiation pattern and a y-z plane radiation pattern of the structures in FIGS. 9 and 10 without loading respectively, and the radiation patterns with or without the structure 1000 for adjusting the EM wave penetration response and obtained by simulation software are almost the same.

Figure 14:
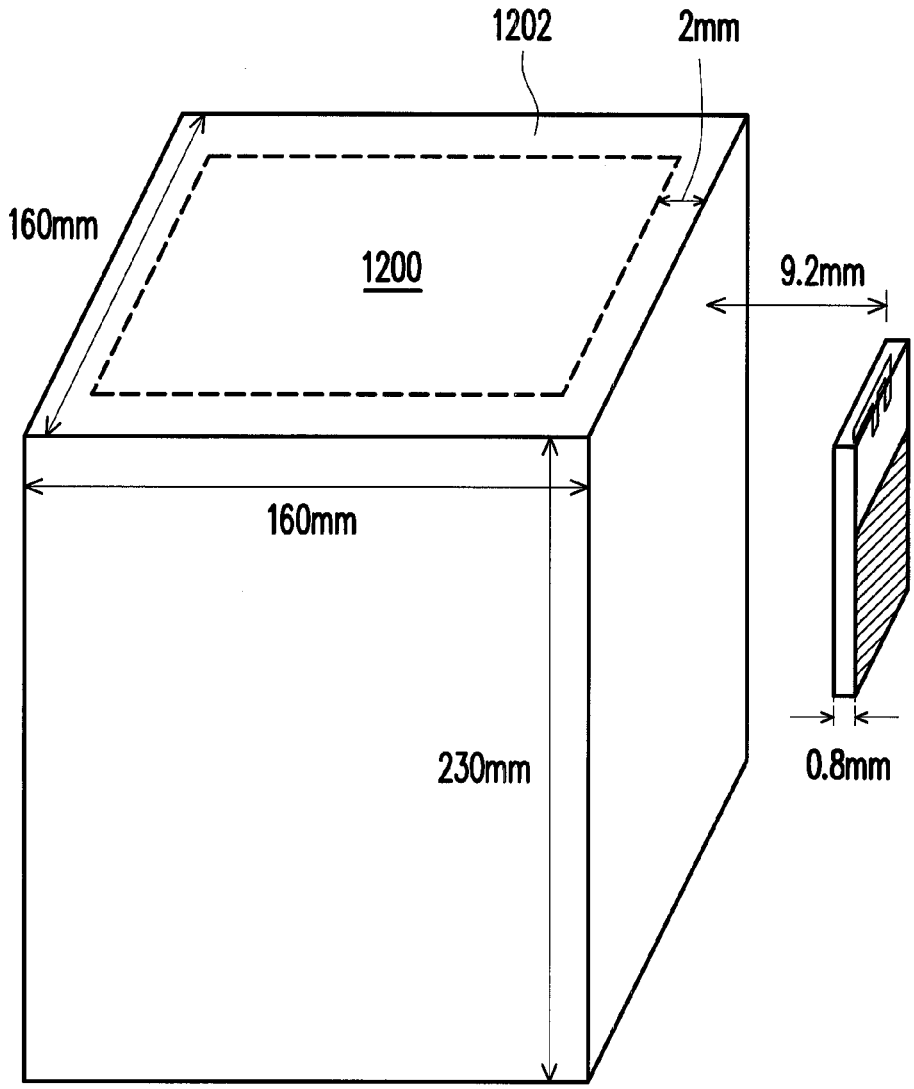
FIG. 14 is an architectural view of an SAR value when simulating the antenna structure in FIG. 9.

FIG. 14 is an architectural view of an SAR value when simulating the antenna structure in FIG. 9, in which a dielectric constant $\epsilon$ of a phantom 1200 is 40, a tissue conductivity $\sigma$ is 1.4 S/m; a dielectric constant $\epsilon$ of a phantom shell 1202 is 3.7; a density of the human body tissue is approximately 1 g/cm$^3$. A Peak $SAR_{1g}$ value obtained from the simulation result is 2.23 mW/g, which is higher than the current international standard value 1.6 mW/g.

Simulation 3

Figure 15:
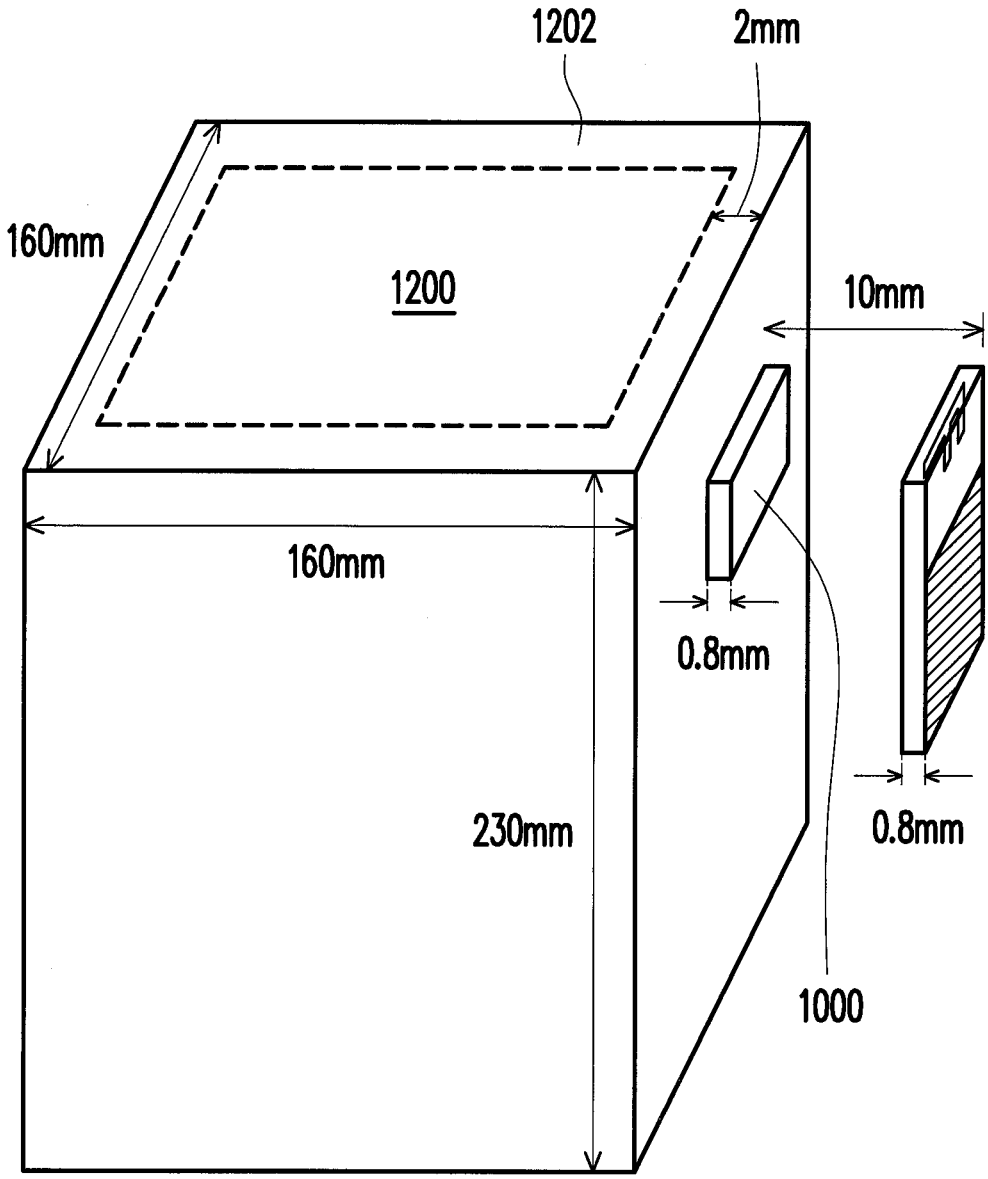
FIG. 15 is an architectural view of an SAR value when simulating the structure in FIG. 10 with a phantom head load.

FIG. 15 is an architectural view of an SAR value when simulating the structure in FIG. 10 loaded with an equivalent human head material, in which the Peak $SAR_{1g}$ value is 1.3 mW/g, and is decreased by about 41.7%, compared with that without the structure 1000 for adjusting the EM wave penetration response.

Figure 16A:
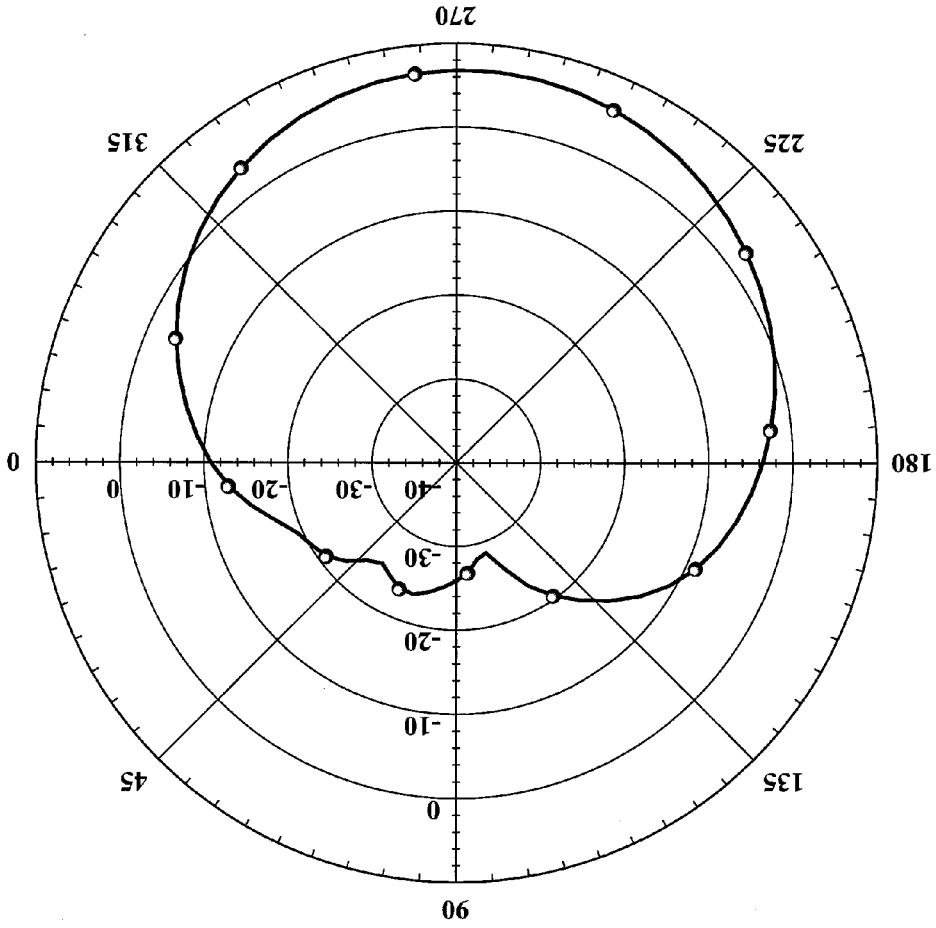
FIG. 16A is an x-z plane radiation pattern of FIG. 15.
Figure 16B:
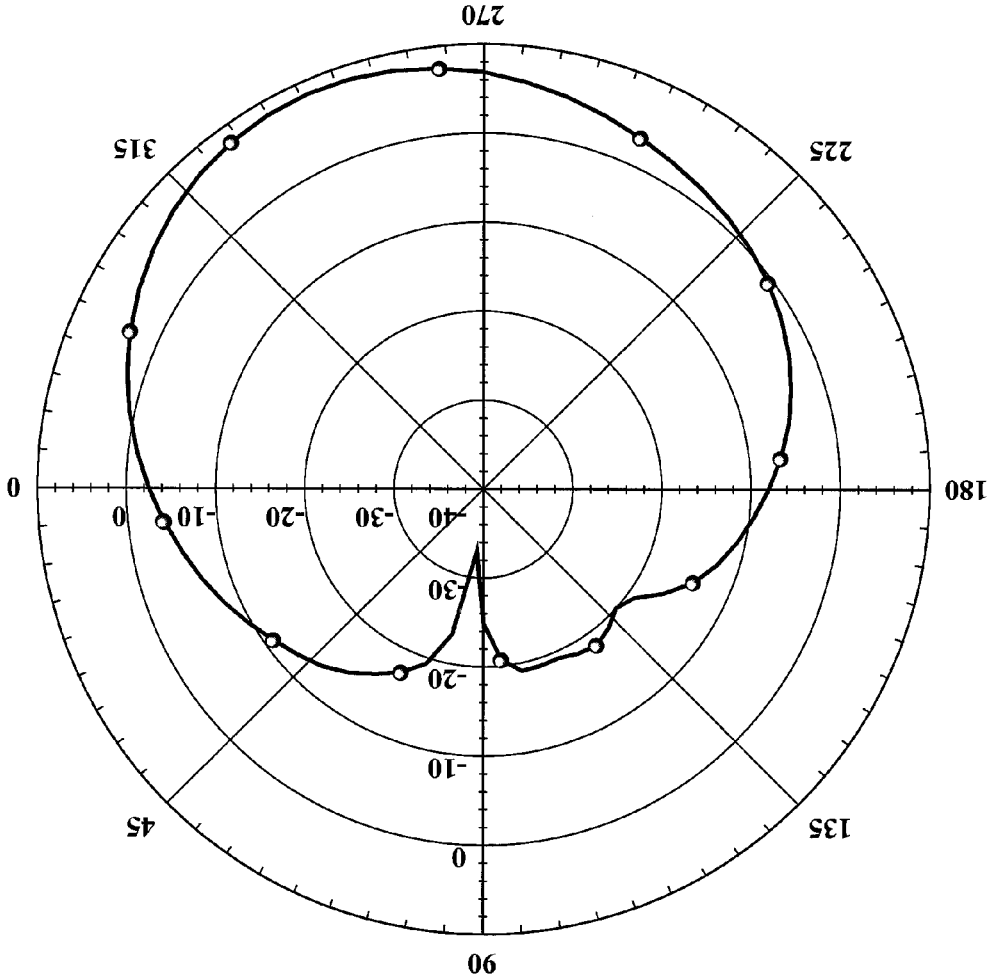
FIG. 16B is a y-z plane radiation pattern of FIG. 15.

FIGS. 16A and 16B are an x-z plane radiation pattern and a y-z plane radiation pattern of FIG. 15 respectively. It can be seen from FIGS. 16A and 16B that the antenna radiates towards a direction away from the phantom head.

Simulation 4

The TRP is measured under situations of FIGS. 9 and 10 (without human head loading) and FIGS. 14 and 15 (with phantom head load). The results are listed in Table 1.

TABLE 1

| | TRP (W) | TRP (dBm) |
|---|---|---|
| FIG. 9 | 0.851 W | 29.30 dBm |
| FIG. 10 | 0.891 W | 29.50 dBm |
| FIG. 14 | 0.212 W | 23.30 dBm |
| FIG. 15 | 0.223 W | 23.49 dBm |

It can be known from Table 1 that, under the situation that the structure 1000 for adjusting the EM wave penetration response exists, no matter the antenna structure is away from or close to the object with the high dielectric constant (such as the human head), the TRP of the antenna can be maintained.

Simulation 5

Figure 3B:
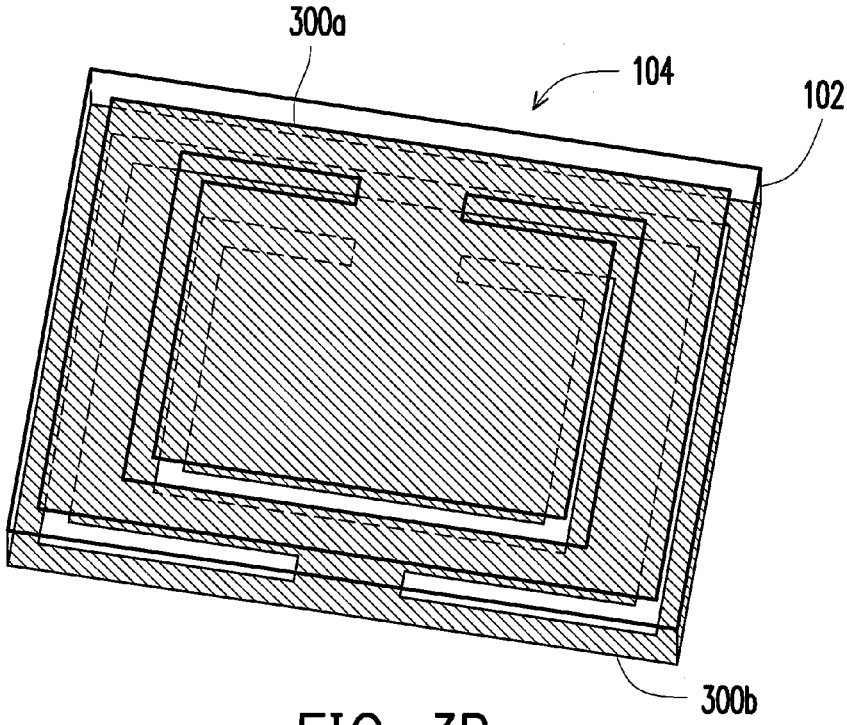
FIG. 3B is an assembled view of an example of the structure unit in FIG. 3A.
Figure 3C:
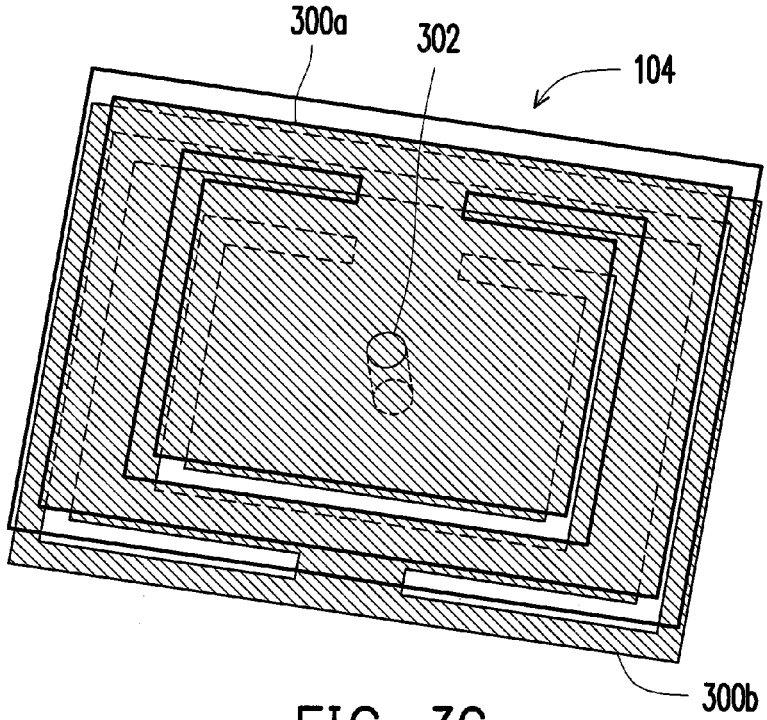
FIG. 3C is an assembled view of another example of the structure unit in FIG. 3A.
Figure 17:
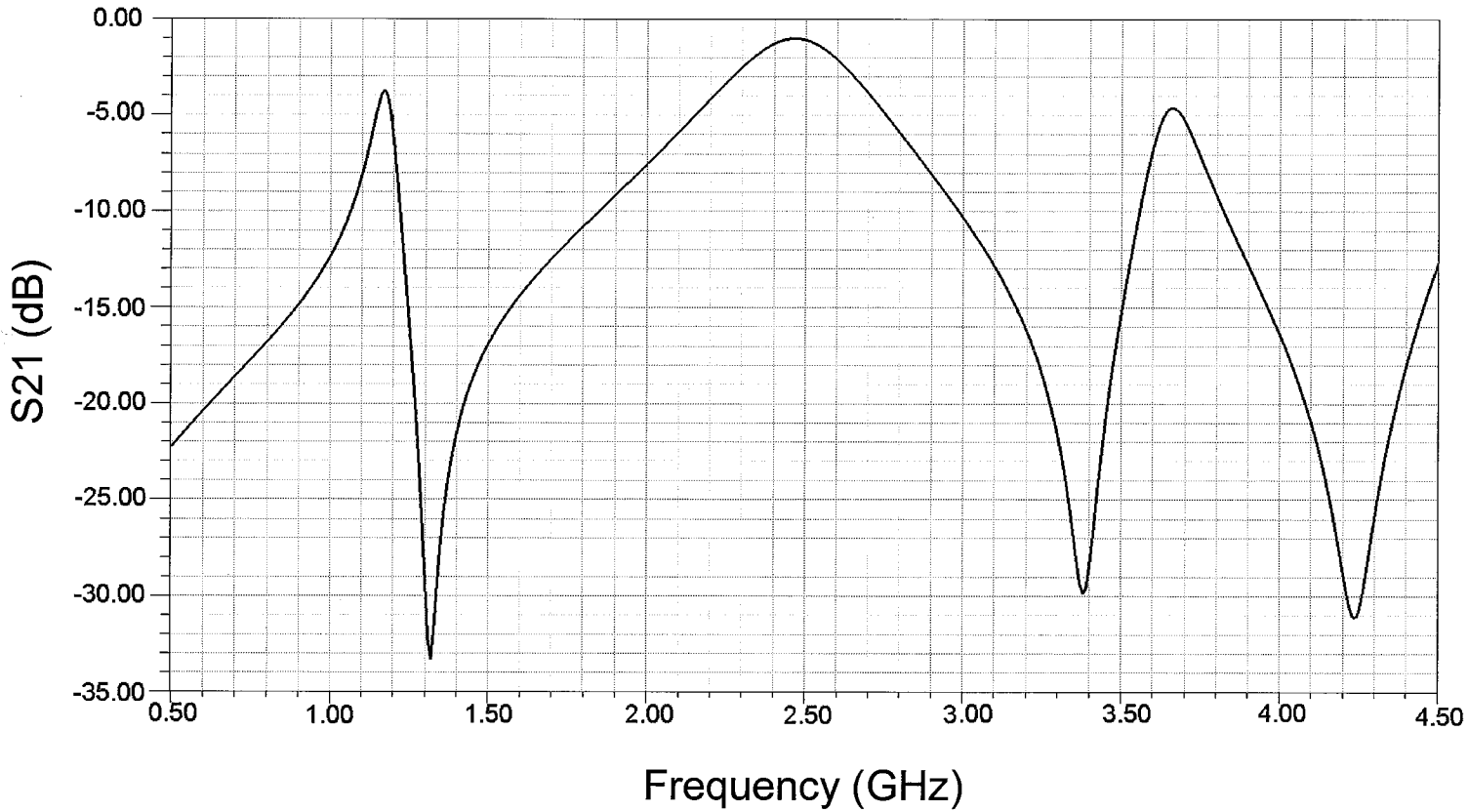
FIG. 17 is an S21 simulation curve diagram of the structure unit in FIG. 3B without a phantom head load.

An FSS structure unit 104 in FIG. 3B is used for performing simulation of the penetration amount (S21) of the EM wave plane wave normal incidence. The dielectric substrate 102 is an FR-4 with a thickness of 0.8 mm and has a dielectric constant of about 4.4. The structure unit 104 has a length of 13 mm and a width of 13 mm. The upper layer 300*a* includes a square patch-shaped structure with a side length of 12 mm and a square unclosed slit with an outer side length of 9 mm; the lower layer 300*b* includes two rectangle unclosed slits on a continuous metal plane with outer side lengths of 12 mm and 7 mm and a width of about 1 mm. FIG. 17 shows the penetration amount of the simulation result. It can be known from FIG. 17 that, without loading the object with the high dielectric constant, in the frequency response of the EM wave penetration response, a response of a pass band exists at about 1.17 GHz, a stop band exists at a higher frequency (about 1.32 GHz), and a broadband pass band exists at 2.47 GHz. Therefore, the structure unit 104 in FIG. 3B after suitable size adjustment is likewise applicable in a dual-frequency mobile communication device or a multi-frequency mobile communication device of an equipment with a radiation frequency of 1.0 GHz to 1.5 GHz, and it is predicted that, when a combined antenna is operated at a frequency of a first pass band, the structure unit 104 has the function of reducing the EM wave penetration when being close to the object with the high dielectric constant.

Simulation 6

Figure 18:
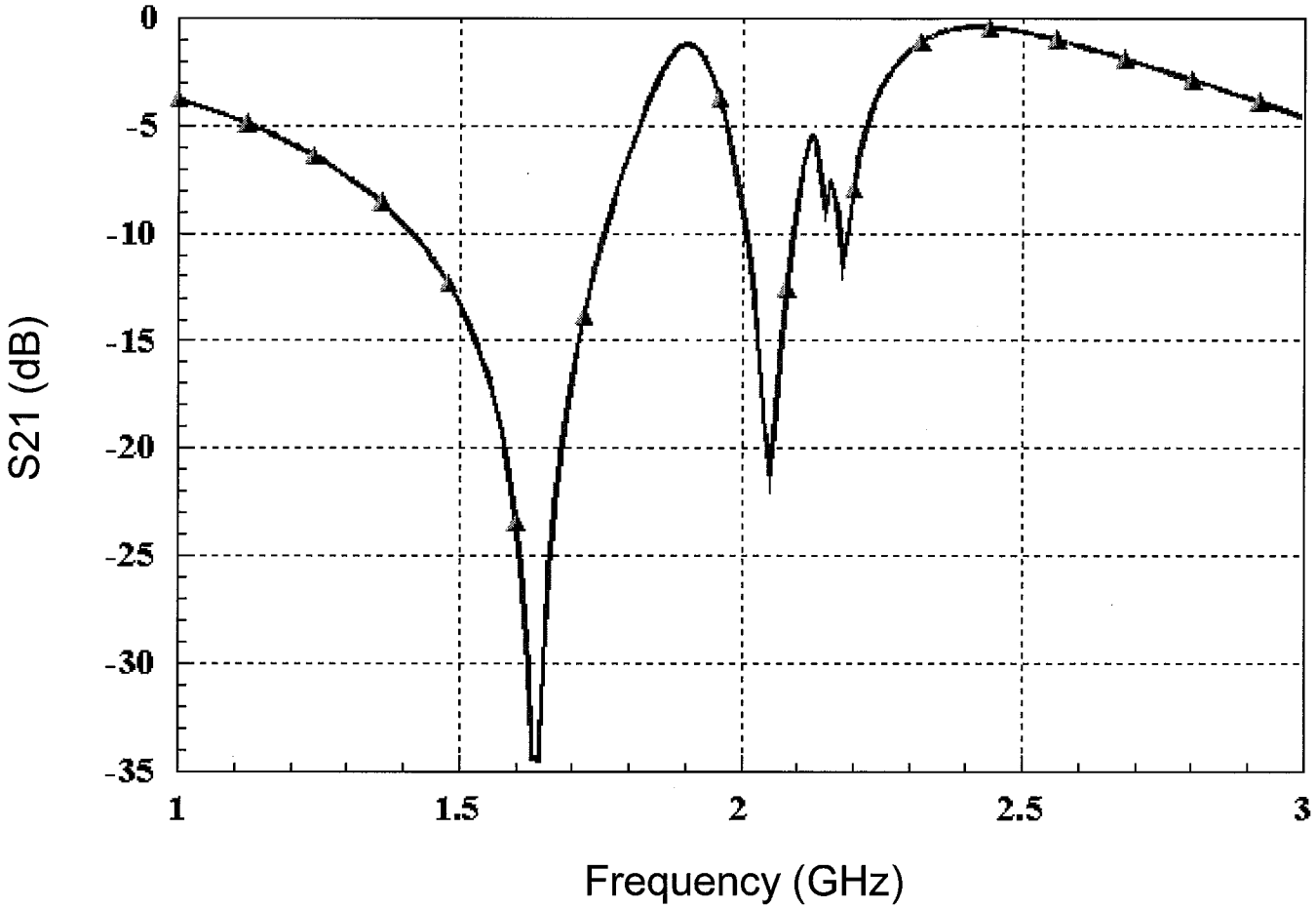
FIG. 18 is a simulation curve diagram of an EM wave penetration amount (S21) of the structure unit in FIG. 2.
Figure 19:
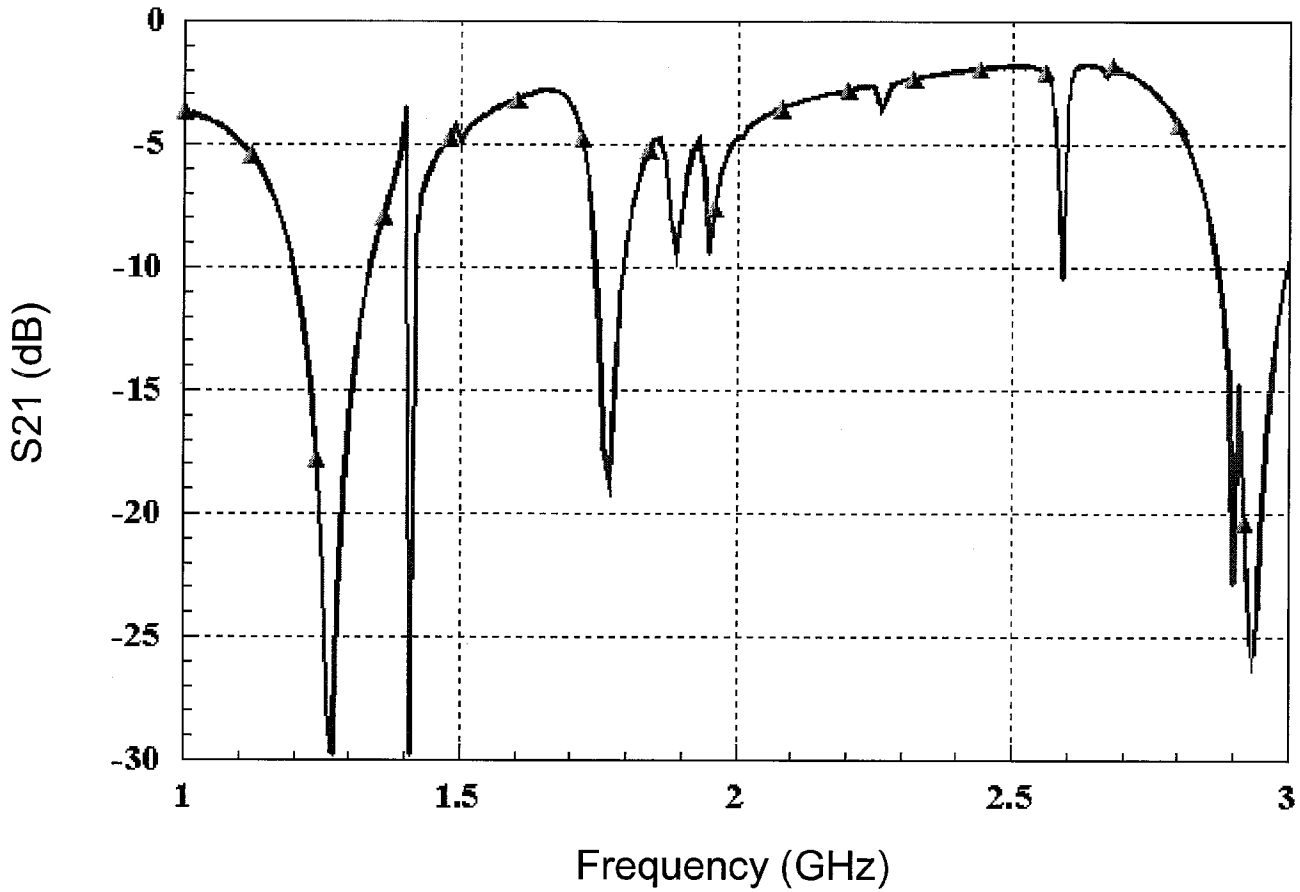
FIG. 19 is a simulation curve diagram of an EM wave penetration amount (S21) of the structure unit with a load in FIG. 2.

A structure unit (that is, 104) in FIG. 2 is used for performing the simulation of the penetration amount (S21) of the EM wave plane wave normal incidence. The results are shown in FIGS. 18 and 19 respectively, in which FIG. 18 shows the simulation result without loading, and FIG. 19 shows the simulation result with loading. It can be known from the simulation results that, without loading, in the frequency of 1.8 GHz to 2.0 GHz, a pass band of the EM wave penetration response exists, and a stop band exists at a higher frequency (about 2.05 GHz). After being closing to the phantom 700 and the phantom shell 702 in FIG. 7, the penetration response curve shifts towards a low frequency (as shown in FIG. 19), and thus the stop band that is initially at a high frequency shifts towards the frequency of 1.8 GHz to 2.0 GHz, such that the penetration energy is reduced significantly, thereby the EM wave absorption of the human body is reduced.

In view of the above, in the present disclosure, by using the loading effect when the resonance structure gets close to the object with the high dielectric constant, the penetration and reflection response of the structure consisting of the resonance structure is automatically adjusted. Because the penetration response curve of the structure of the present disclosure will shift towards a low frequency at capacitance loading, such that the structure that is initially operated in the penetration band is changed to be operated at the stop band under loading conditions, such that the TRP of the antenna is maintained, and the SAR is reduced when being closing to the object with the high dielectric constant (for example, a human body).

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A structure for adjusting an electromagnetic wave (EM wave) penetration response, comprising:

a dielectric substrate, provided with an upper surface and a lower surface; and a plurality of structure units, disposed on the upper surface, the lower surface, or the upper surface and the lower surface of the dielectric substrate, wherein the structure units consist of a plurality of meandering metal lines, a plurality of metal patch-shaped structures, a plurality of complementary slits, or a combination thereof, to enable the EM wave penetration response of the structure for adjusting the EM wave penetration response to at least comprise a pass band and a stop band, wherein the stop band is adjacent to the pass band, and a frequency of the stop band is higher than that of the pass band, if a distance between the structure for adjusting the EM wave penetration response and an object with a high dielectric constant is longer than a predetermined distance, the pass band covers a radiation frequency of an antenna; and if the distance between the structure for adjusting the EM wave penetration response and the object with the high dielectric constant is within the predetermined distance, the stop band covers the radiation frequency of the antenna.

2. The structure for adjusting the EM wave penetration response according to claim 1, wherein the object with the high dielectric constant comprises a human body.

3. The structure for adjusting the EM wave penetration response according to claim 2, wherein the radiation frequency of the antenna is between 1.8 GHz and 2.0 GHz.

4. The structure for adjusting the EM wave penetration response according to claim 1, wherein when the distance from the structure for adjusting the EM wave penetration response to the object with the high dielectric constant is close to the predetermined distance, the stop band of the EM wave penetration response of the structure for adjusting the EM wave penetration response gradually covers the radiation frequency of the antenna.

5. The structure for adjusting the EM wave penetration response according to claim 1, wherein each of the structure units consists of a first unclosed loop and a second unclosed loop in a back-to-back manner.

6. The structure for adjusting the EM wave penetration response according to claim 5, wherein a length ratio of the first unclosed loop to the second unclosed loop is between 1.02:1 and 1.41:1.

7. The structure for adjusting the EM wave penetration response according to claim 6, wherein the length ratio of the first unclosed loop to the second unclosed loop is 1.14:1.

8. The structure for adjusting the EM wave penetration response according to claim 1, wherein the antenna comprises a planer inverted-F antenna (PIFA).

9. An antenna structure for adjusting an electromagnetic wave (EM wave) radiation characteristic, comprising:

an antenna; and a structure for adjusting an EM wave penetration response, disposed on a radiation path of the antenna, separated from the antenna by a pitch lower than a ¼ wavelength of the antenna radiation frequency, and comprising:

a dielectric substrate, provided with an upper surface and a lower surface; and a plurality of structure units, disposed on the upper surface, the lower surface or the upper surface and the lower surface of the dielectric substrate, wherein the structure units consist of a plurality of meandering metal lines, a plurality of metal patch-shaped structures, a plurality of complementary slits, or a combination thereof, to enable the EM wave penetration response of the structure for adjusting the EM wave penetration response to at least comprise a pass band and a stop band, wherein the stop band is adjacent to the pass band, and the frequency of the stop band is higher than that of the pass band;

if a distance between the antenna structure and an object with a high dielectric constant is higher than a predetermined distance, the pass band covers a radiation frequency of the antenna; and if the distance between the antenna structure and the object with the high dielectric constant is within the predetermined distance, the stop band covers the radiation frequency of the antenna.

10. The antenna structure for adjusting the EM wave radiation characteristic according to claim 9, wherein the object with the high dielectric constant comprises a human body.

11. The antenna structure for adjusting the EM wave radiation characteristic according to claim 10, wherein the radiation frequency of the antenna is between 1.8 GHz and 2.0 GHz.

12. The antenna structure for adjusting the EM wave radiation characteristic according to claim 9, wherein when the distance from the structure for adjusting the EM wave penetration response to the object with the high dielectric constant is close to the predetermined distance, the stop band of the EM wave penetration response of the structure for adjusting the EM wave penetration response gradually covers the radiation frequency of the antenna.

13. The antenna structure for adjusting the EM wave radiation characteristic according to claim 9, wherein the antenna comprises a planer inverted-F antenna (PIFA).

14. The antenna structure for adjusting the EM wave radiation characteristic according to claim 9, wherein each of the structure units consists of a first unclosed loop and a second unclosed loop in a back-to-back manner.

15. The antenna structure for adjusting the EM wave radiation characteristic according to claim 14, wherein a length ratio of the first unclosed loop to the second unclosed loop is between 1.02:1 and 1.41:1.

16. The antenna structure for adjusting the EM wave radiation characteristic according to claim 15, wherein the length ratio of the first unclosed loop to the second unclosed loop is 1.14:1.

* * * * *